US009949546B2

(12) United States Patent
May

(10) Patent No.: US 9,949,546 B2
(45) Date of Patent: Apr. 24, 2018

(54) SOLID SHAVING GEL APPLICATOR

(71) Applicant: SHAV Shower Bar Corporation, Ottawa (CA)

(72) Inventor: Nicholas May, Kanata (CA)

(73) Assignee: Shav Shower Bar Corporation, Ottawa, Ontario (CA)

( * ) Notice: Subject to any disclaimer, the term of this patent is extended or adjusted under 35 U.S.C. 154(b) by 0 days.

(21) Appl. No.: 15/113,300

(22) PCT Filed: Jan. 14, 2015

(86) PCT No.: PCT/CA2015/050022
§ 371 (c)(1),
(2) Date: Jul. 21, 2016

(87) PCT Pub. No.: WO2015/109398
PCT Pub. Date: Jul. 30, 2015

(65) Prior Publication Data

US 2017/0020262 A1 Jan. 26, 2017

Related U.S. Application Data

(60) Provisional application No. 61/930,187, filed on Jan. 22, 2014.

(51) Int. Cl.
*A45D 40/20* (2006.01)
*A45D 27/00* (2006.01)
*A45D 40/00* (2006.01)

(52) U.S. Cl.
CPC ..... *A45D 27/00* (2013.01); *A45D 40/00* (2013.01)

(58) Field of Classification Search
CPC ..... B43K 23/016
USPC ..... 401/88, 262–266
See application file for complete search history.

(56) References Cited

U.S. PATENT DOCUMENTS

| | | | | |
|---|---|---|---|---|
| 7,494,295 | B2 * | 2/2009 | Delage | A45D 33/02 401/126 |
| 7,722,276 | B2 * | 5/2010 | Gueret | A45D 34/042 401/205 |
| 2002/0127046 | A1 * | 9/2002 | Gueret | A45D 40/26 401/266 |

FOREIGN PATENT DOCUMENTS

| | | | |
|---|---|---|---|
| FR | 424447 | A | 5/1911 |
| FR | 436667 | A | 4/1912 |
| FR | 697374 | A | 1/1931 |
| GB | 356836 | A | 9/1931 |
| GB | 381287 | A | 10/1932 |

* cited by examiner

*Primary Examiner* — Lori Baker
(74) *Attorney, Agent, or Firm* — Dilworth & Barrese, LLP

(57) ABSTRACT

A resealable shaving solid applicator comprising an upper section, a support for a shaving solid, a shaving solid, and a lower section is provided. The support for a shaving solid may comprise one or more resilient tabs for engaging a shaving solid to form a mounted shaving solid. Methods for introducing a shaving solid into a resealable shaving solid frame to form a resealable shaving solid applicator are also provided herein.

19 Claims, 5 Drawing Sheets

SOLID SHAVING GEL APPLICATOR

FIELD OF INVENTION

The present invention relates generally to applicators for shaving solids, and to methods of preparing shaving solid applicators. The shaving solid applicators may comprise a support for a shaving solid featuring one or more resilient tabs for engaging a shaving solid to form a mounted shaving solid. Methods of preparing shaving solid applicators may involve top-fill and/or hot pour processes.

BACKGROUND

Skin can become irritated or otherwise damaged due to the use of a safety razor while shaving. A safety razor can irritate the skin if it is not used in combination with an adequate lubricant used to protect the skin. Thus, lubricants developed for shaving are often applied prior to shaving to prevent razor burn. Even when applied after the skin has been irritated, a lubricant can prevent any further damage from occurring.

Shaving lubricants are generally sold as emulsions, liquids, gels, or solids. In emulsion or liquid form, the shaving lubricants are generally packed in containers such as jars. Gels, and liquids on occasion, are typically dispensed from squeeze tubes, pressurised or pump actioned containers. Solid shaving soaps are generally packaged in a soap bar form.

The choice of applicator for a particular product generally depends on the design or functionality of the package, the additives in the composition, and the desired characteristics of the composition, for example phase, feel, shape, etc. For example, antiperspirant-type applicators are generally used in dry environments and often moulded to have a dome top for optimal use in the pitted area of the underarm. Similarly, lipstick-type applicators are designed to be used in dry environments, relatively small in size, closable and often moulded to have a flat and angled portion intended for ideal delivery onto the users lips.

Some people use shaving lubricants both inside and outside of the shower. For example, when shaving their legs, people will often apply a film or lather of soap to an area of skin to be shaved, shave that area, apply soap to another area, and shave that area. This process is repeated until shaving is complete. Shaving in this manner may be difficult and frustrating, as it generally requires the shaver to hold a slippery, wet bar of soap in one hand while wielding a razor in the other hand, often while standing in an awkward position on a slippery shower floor.

Applicators have yet to be developed for ideal dispensing of a shaving solid. Attempts have been made to assist in holding a wet shaving solid by incorporating the solid into antiperspirant-type applicators which use either a turn-dial or thumb-push to control dispensing. However, antiperspirant-type applicators require the additional step of manual dispensing by the user as the solid is consumed during application, and require multiple parts. Additionally, like other similar applicators/nondispensing-type applicators, applicators are generally not intended for use in wet environments. In particular, they are intended to stand with the solid pointed upwards, which encourages the pooling of water on or around the solid. Furthermore, traditional applicators lack ideal surface area for dispensing solid over a large area of the body, pronounced features for holding the applicator, and resilient mounting of the solid for the user's comfort and the applicator's durability.

Attempts have been made to reduce steps required to shave by providing soap mounted on a razor. For example, a razor that carries a shaving preparation, e.g., in the form of a solid cake of soap that surrounds the cartridge is available. However, this makes for a very large razor which can be difficult to navigate in constrained areas such as the bikini area. Thus, a limited mass of soap must be mounted onto this type of razor, the soap often being exhausted long before the life of the razor.

A need therefore exists to provide an applicator that overcomes or mitigates at least one of the downsides associates with conventional applicators.

SUMMARY OF THE INVENTION

In one embodiment, the invention provides for a resealable shaving solid applicator comprising:

an upper section;

a support for a shaving solid which is engagable with the upper section to form a shaving solid applicator oriented to expose a surface of a shaving solid for application, and which comprises one or more resilient tabs for engaging a shaving solid to form a mounted shaving solid; and a lower removable section joinable to the shaving solid applicator such that a shaving solid mounted on the shaving solid applicator is sealed from the surrounding environment when the lower removable section is in a joined position.

In a further embodiment of the resealable shaving solid applicator or applicators outlined above, the support for a shaving solid further comprises one or more fluid communication channels for engaging a shaving solid.

In a further embodiment of the resealable shaving solid applicator or applicators outlined above, the lower removable section further comprises two or more bases such that the resealable shaving solid applicator may be stably positioned in two or more orientations.

In a further embodiment of the resealable shaving solid applicator or applicators outlined above, the lower removable section comprises a first base and a second base, wherein the first base allows the resealable shaving solid applicator to be positioned in a first orientation, and wherein the second base allows the resealable shaving solid applicator to be positioned in a second orientation.

In a further embodiment of the resealable shaving solid applicator or applicators outlined above, the first and second bases are substantially perpendicular to one another.

In a further embodiment of the resealable shaving solid applicator or applicators outlined above, the first base is substantially parallel to the longitudinal axis of the support for a shaving solid when joined to the lower removable section.

In a further embodiment of the resealable shaving solid applicator or applicators outlined above, the second base is for supporting the resealable shaving solid applicator in an upright position.

In a further embodiment of the resealable shaving solid applicator or applicators outlined above, the upper section comprises a base for stably supporting the resealable shaving solid applicator in an upright position.

In a further embodiment of the resealable shaving solid applicator or applicators outlined above, the base on the upper section stabilizes the resealable shaving solid applicator in an upright position when the lower removable section is removed, joined, or both.

In a further embodiment of the resealable shaving solid applicator or applicators outlined above, the upper section comprises a base aligned such that the base of the upper section is at least partially continuous with a base of the lower removable section when the lower removable section is joined, so as to form an expanded base for supporting the resealable shaving solid applicator in an upright position.

In a further embodiment of the resealable shaving solid applicator or applicators outlined above, the upper section further comprises one or more grips for a user.

In a further embodiment of the resealable shaving solid applicator or applicators outlined above, the support for a shaving solid further includes one or more indicators for indicating a shaving solid level.

In a further embodiment of the resealable shaving solid applicator or applicators outlined above, an inside or inside surface of the lower removable section is substantially concave on at least one end, allowing the lower removable section to be removed from the resealable shaving solid applicator to reduce damage caused to a shaving solid.

In a further embodiment of the resealable shaving solid applicator or applicators outlined above, the lower removable section further comprises a protrusion for simplifying removal of the lower removable section from the resealable shaving solid applicator, the protrusion protruding from the at least one concave end.

In a further embodiment of the resealable shaving solid applicator or applicators outlined above, the applicator further comprises a shaving solid.

In a further embodiment of the resealable shaving solid applicator or applicators outlined above, the shaving solid is a propylene glycol-based solid shaving composition comprising less than 15% by wt. of fatty acid salt and having a melting point between about 38° C. and about 49° C. when saturated with water.

In a further embodiment of the resealable shaving solid applicator or applicators outlined above, the shaving solid is mounted to the support for a shaving solid to form a mounted shaving solid.

In a further embodiment of the resealable shaving solid applicator or applicators outlined above, the mounted shaving solid comprising the support for a shaving solid and the shaving solid is a user-replaceable consumable.

In a further embodiment of the resealable shaving solid applicator or applicators outlined above, the inside of the lower removable section is coated with a non-stick coating to prevent the shaving solid from sticking to the inside of the lower section.

In a further embodiment of the resealable shaving solid applicator or applicators outlined above, the accessible surface area of the shaving solid is from about 17 $cm^2$ to about 40 $cm^2$.

In yet a further embodiment, the invention provides for a method of introducing a shaving solid into a resealable shaving solid applicator, said resealable shaving solid applicator comprising a support for a shaving solid which comprises one or more resilient tabs, and optionally comprises one or more fluid communication channels, for engaging a shaving solid; and a lower removable section which is joinable to the support for a shaving solid, and which comprises a filling base at one end; said method comprising the steps of:

introducing a shaving solid in a liquid state into the lower removable section joined to the support for a shaving solid and oriented on the filling base, such that the lower removable section is filled above the level of the resilient tabs of the support for a shaving solid, allowing the shaving solid in a liquid state to solidify, forming a shaving solid molded in the form of the inside of the lower removable section, and engaged with the support for a shaving solid.

In a further embodiment of the method or methods outlined above, the resealable shaving solid applicator further comprises an upper section engagable with the support for a shaving solid, and the method further comprising a step of engaging the upper section with the support for a shaving solid.

In a further embodiment of the method or methods outlined above, the shaving solid is a propylene glycol-based solid shaving composition comprising less than 15% by wt. of fatty acid salt and having a melting point between about 38° C. and about 49° C. when saturated with water.

In a further embodiment of the method or methods outlined above, the step of introducing is a hot pour process, a top-fill process, an extrusion, a combination thereof.

DETAILED DESCRIPTION

Figure 1:
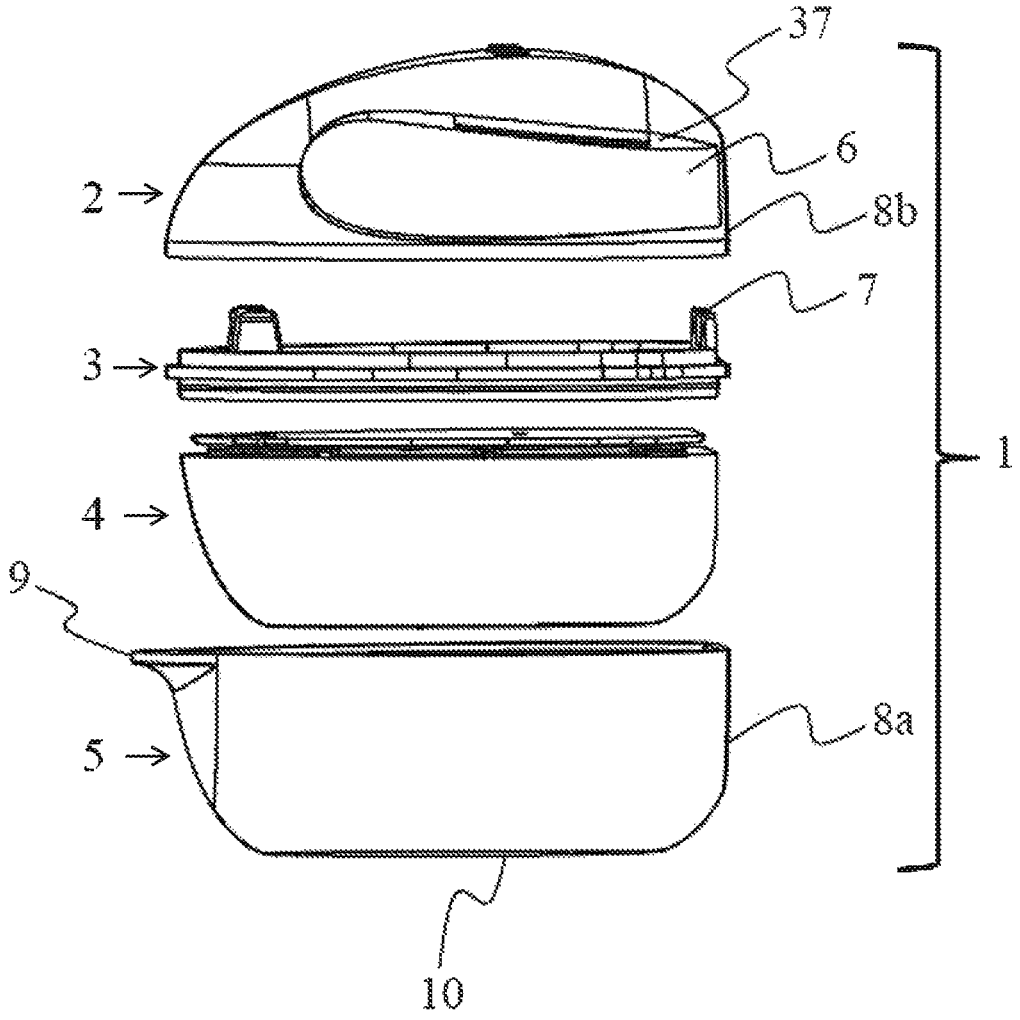
FIG. 1 shows an exploded view illustrative of an embodiment of a resealable shaving solid applicator filled with a shaving solid.

Described herein are resealable shaving solid applicators, and methods of introducing shaving solids into resealable shaving solid containers. It will be appreciated that the following description is intended to be illustrative of embodiments of resealable shaving solid applicators, and methods of introducing shaving solids into resealable shaving solid containers, and is not intended to be limiting.

In certain non-limiting embodiments, there is provided a shaving solid applicator comprising an upper section, a support for a shaving solid, and a lower removable section. In a further embodiment, the upper section may be capable of interlocking with, engaging with, coupling with, snapping, hooking, clipping, or otherwise joining to the support for a shaving solid to form a shaving solid applicator oriented to expose a surface of a shaving solid for application.

In one embodiment, the support for a shaving solid may comprise one or more resilient tabs, wings, flaps, or other suitable structural elements for engaging, binding, coupling to, or otherwise mechanically linking to a shaving solid to form a mounted shaving solid. The resilient tabs, wings, flaps, or other suitable structural elements may be flexible and/or may resiliently deflect to a flexed position above and/or below the plane of the support for a shaving solid, imparting some flexibility to the shaving solid applicator, which may enhance user comfort during use. The resilient features may deflect independently of one another. The one or more resilient tabs, wings, flaps, or other suitable structural elements may be robust or long-lasting elements, and may prevent or reduce damage to the shaving solid applicator, the resealable shaving solid applicator, or a shaving solid mounted to the support for a shaving solid or a shaving solid applicator, caused by external pressure or force. The one or more resilient features may vary in shape, quantity, thickness, and size, and may include words or icons to, for example, indicate to a user that it is time to replace. In some non-limiting embodiments, the resilient features may have a thickness of at least 0.3 mm, for example, about 1 mm or 2 mm.

The thickness and length of one or more resilient tabs or resilient features may be the same or different from one another (in the case of more than one), and an elastomeric material may be used to give the features the desired flexural or resilient characteristics. It will be appreciated that the following dimensions are not intended to be limiting but merely illustrative. The features may be about 0.3 mm to about 3 mm, for example, 1 mm. The length may be from about 4 mm to about 60 mm, for example between 10 to 40 mm. The width can vary, and in some embodiments may be from about 5 to about 35 mm, for example from about 15 mm to about 25 mm, depending on the number of wings or features present. In an embodiment, the one or more of the wings or features may extend towards the center of the support for a shaving solid, or away from the center of a support for a shaving solid. The resilient features may, in some embodiments, comprise hinges. It is noted that the distance traveled and the angle of the flex of the wings may vary depending on the force applied, leverage points, structure, and characteristics of the support for a shaving solid, and should not be considered limiting.

In one embodiment, as a shaving solid mounted to a support for a shaving solid nears exhaustion, inward deflection of one or more resilient features may allow inward deflection of the shaving solid, and/or may provide a comfortable cushioning sensation to the user during use over contoured surfaces such as the shin, knee, and elbow. In one embodiment, an inward deflection angle may be at least about 0°, for example from about 0° to about 40°, or about 0° to about 30°. The inward deflection angle may be measured as the angle of displacement from an undeflected position to a deflected position. Outward deflection may function as a safety mechanism by enabling flexibility (movement of a mounted shaving solid) when an external force is applied to a mounted shaving solid thereby reducing shear stress on the mounting system and reducing the risk of shearing a mounted shaving solid away from the support for a shaving solid during, for example, improper removal of the lower removable section and in the incidence of impact from a fall e.g., onto the shower floor. Resilient deflection from an outward, flexed position to a normal, undeflected position may help reposition a damaged shaving solid into its proper place, allowing for continued use. In one embodiment, an outward deflection angle may be at least about 0°, for example from about 0° to about 40°, or about 0° to about 30°. The outward deflection angle may be measured as the angle of displacement from an undeflected position to a deflected position. In some embodiments, a resilient feature may detent both inwardly and outwardly as discussed, having flexibility both inwardly and outwardly. In certain embodiments, a shaving solid mounted on a support for a shaving solid may be capable of flexing or moving at least 0.5°, for example between about 0.5° to about 30°, or from about 1° to about 15° degrees. In a further embodiment, resilient deflection from an outward flexed position to an undeflected position may help reposition a damaged shaving solid on the shaving solid support, allowing continued use of a damaged applicator.

In another embodiment, the lower removable section may be capable of interlocking with, engaging with, coupling with, hooking, clipping, snapping to, or otherwise joining to the support for a shaving solid or the shaving solid applicator such that a shaving solid mounted on the support for a shaving solid or the shaving solid applicator is at least partially sealed, protected, blocked, or otherwise separated from the surrounding environment.

In some examples, the support for a shaving solid may further comprise fluid communication channels for engaging a shaving solid when in a liquid or pourable state during filling or manufacture of the applicator. The fluid communication channels may be openings, passages, channels, or other pathways which allow a shaving solid in a liquid form to pass from the bottom of the support for a shaving solid to the top of the support for a shaving solid. In some embodiments, the shaving solid in a liquid form may pass through the support for a shaving solid through the fluid communication channels, submerging at least a portion of the resilient tabs, wings, flaps, or other suitable structural elements of the support for a shaving solid.

In one embodiment, the lower removable section may comprise two or more bases for supporting the resealable shaving solid applicator, such that the resealable shaving solid applicator may be stably positioned in two or more orientations. In some embodiments, the lower removable section may comprise a first base and a second base, supporting the resealable shaving solid applicator in a first and second position, respectively. In a further embodiment, the first and second bases may be substantially perpendicular to one another. In yet another embodiment, the first base may be substantially parallel to the longitudinal axis of the support for a shaving solid when it is joined to the lower removable section, and may be used as a filling base during introduction of a shaving solid which may be in a liquid form. In still another embodiment, the second base may be for supporting the resealable shaving solid applicator in an upright position, and may orient the resealable shaving solid applicator so as to prevent water pooling.

In some embodiments, the upper section may comprise a base for supporting the resealable shaving solid applicator in an upright position, and may orient the resealable shaving solid applicator so as to prevent water pooling. The base of the upper section may support the shaving solid applicator in an upright position when the lower removable section is installed, removed, or both. In some embodiments, a base on the upper section may be aligned with a base on the lower removable section, forming an expanded base for supporting the resealable shaving solid in, for example, an upright position.

The term "base" as utilized herein is intended to encompass at least any suitable supportive surface or structure, including but not limited to a substantially flat or concave surface, legs, a pedestal, a tripod, a supportive structure featuring a suction cup, or any other appropriate supportive structure as will be known or understood to those of skill in the art.

In one embodiment, the resealable shaving solid applicator may comprise an upper section with one or more grips for a user. The grips may allow a user to grasp the resealable shaving solid applicator more securely and/or to use the applicator in a wet environment more easily or with soapy or slippery hands. It should be understood that the term "grip" utilized herein is intended to refer to any grip element including for example a depression, groove, ridge, handle, textured surface, bumps, protrusions, or other structural feature, or multiples or combinations thereof, which improves a user's ability to hold and/or use the resealable shaving solid applicator. By way of non-limiting example, a grip may include depressions for accommodating a user's thumb and finger(s), and may include a ridge or finger catch for enhanced usability, especially in wet conditions.

In some examples, the support for a shaving solid may further include one or more indicators for indicating a shaving solid level. By way of example, the indicators may identify to a user that a shaving solid level is getting low and should be replaced soon. In another embodiment, the indicators may display the product brand, messages to the user, or present other useful information to the user. The level indicator may also inform the manufacturer of the required fill level for quality control.

In one embodiment, the lower removable section of the resealable shaving solid applicator may serve as a lid, which may be placed on the applicator during storage and removed for use.

In one embodiment, the resealable shaving solid applicator may be substantially ovate, egg-shaped, oval, rounded or square in shape.

In another embodiment, the lower removable section may comprise an inside or inside surface that is at least partially concave or inwardly curved on at least one end. It will be appreciated that the internal surface may have any suitable shape including square, curved, angular, rectangular, etc., such that it forms a suitable cover for a shaving solid. The lower removable section may serve as a mold for a shaving solid, and the shaving solid may be formed in the negative shape of the inside of the lower removable section. In some embodiments, the shape of the inside of the lower removable section and the shape of the shaving solid may be complimentary, or provide sufficient clearance, such that the lower removable section may be removed to reduce damaging, scraping, or dislodging the shaving solid from the support for a shaving solid. In some embodiments, the lower removable section may be removed at an angle, or pivotally opened, without damaging, scraping, or dislodging the shaving solid from the support for a shaving solid. In some embodiments, an insert for the lower removable section may be provided for further molding the shaving solid. In another embodiment, the lower removable section may include a protrusion on the exterior surface, which may be oriented on the same end of the lower removable section as the interior concave end of the lower removable section, and may serve to facilitate removal of the lower removable section by a user and especially pivotal opening of the lower section.

In still another embodiment, the resealable shaving solid may further comprise a shaving solid or shaving compound or shaving composition. In some embodiments, the shaving solid may be engaged or otherwise mounted to the support for a shaving solid. The shaving solid may be useful for application to an area of the body to be shaved. In an embodiment, the shaving solid may be a water-activateable shaving composition. The shaving solid may be formed in the shape of the lower removable section, and may be molded by the lower removable section. The shaving solid may be rounded, curved, or convex on at least one end, and may be shaped so as to co-operated with the lower removable section so as to allow removal of the lower removable section without damaging, scraping, or dislodging the shaving solid from the support for a shaving solid.

In some embodiments, the shaving solid may be a propylene glycol-based solid shaving composition comprising less than 15% by wt. of a fatty acid salt and having a melting point between about 38° C. and about 49° C. when saturated with water. The shaving solid may be a shaving solid as disclosed in PCT application number PCT/CA2013/000781 filed Sep. 18, 2013, which is herein incorporated by reference. In certain embodiments, a solid shaving product comprising a composition of water, alcohol, polyoxyethylene glycol, propylene glycol, fatty acids and fatty acid salts may be used. The composition may be capable of being eroded upon being drawn across a surface such as a user's skin.

In one embodiment, the shaving solid may be a propylene glycol based composition comprising fatty acid salts. Optionally, the shaving composition may also include surfactants, chelating agents, antimicrobial agents, anti-inflammatory agents, emulsifiers, humectants, fragrance, colours, hair softeners, preservatives, stabilizers, wax, ultraviolet protective agents, vitamins, hair growth inhibitors, polymers, or a combination thereof. The composition may comprise water, alcohols, polyols, polyether diols, fatty acids, fatty acid amines and may optionally include Terpinen-4-ol, α-terpinene, β-terpinene, 1,8-cineole and ethylenediaminetetraacetic acid salts. Examples of composition elements may include glycerine, propylene glycol, dimethicone, dimethiconol, steareth 20, sodium stearate, polyethylene glycol powder, cocamide monoethanolamine (MEA), and tea tree oil. The propylene glycol may at least partly serve to both hydrate hairs prior to shaving as well as to moisturize the skin. Further, different oils may be added into the product formulation further enhancing the feel of the product by reducing the desiccation of the skin. The composition may be prepared into a solid or cake form that may allow application to the skin both with and without water. When water-activated and agitated over the skin, the composition may provide a foamy lather that may provide further lubrication for shaving. When water-activated and gently dispensed over the skin, the composition may provide almost no lather.

In some embodiments, the shaving solid surface may be shaped in such a manner, have a suitable topography, and/or have a surface area of sufficient size, so as to be useful for application to a part of the body to be shaved. The shaving solid may have a surface that is at least partially substantially flat, or concave, for example. The shaving solid may have a portion that is sized and shaped to accommodate application to constrained or less accessible regions of the body. The composition may erode as it is drawn across the surface of a user's skin, providing lubricant to the skin for shaving. In some embodiments, the shaving solid may provide between about 17 $cm^2$ and about 40 $cm^2$ of accessible surface area, for example about 25 $cm^2$ to about 30 $cm^2$ of accessible surface area. In some embodiments, the shaving solid may provide at least 17 $cm^2$ of accessible surface area.

In certain embodiments, the shaving solid may be between about 10 g and about 400 g, for example between about 30 g and about 175 g. In another embodiment the shaving solid may be 100 g or less facilitating for airline carry-on travel.

As will be recognized by those of skill in the art, the term "shaving solid" is intended to refer to any of a variety of suitable shaving compositions known in the art. Although the term "shaving solid" is used, it should be recognized that any suitable shaving compound or composition, which may comprise shaving gel, shaving liquid, and shaving foam, is also encompassed by the term "shaving solid".

In some embodiments, the shaving solid, which may be mounted to a support for a shaving solid, may be a consumable, user-replaceable product.

In a further embodiment, the inside of the lower removable section may be coated with a non-stick coating which may reduce or prevent the shaving solid from sticking to the inside of the lower section.

In some embodiments, at least some components of the resealable shaving solid applicator may be made of plastic, a durable polymer material, rubber, a thermoplastic elastomer (TPE) injection molded over a plastic form comprising polyethylene, polyethylene, a polyethylene-copolymer or the like, an acrylonitrile-butadiene-styrene (ABS) copolymer, or other suitable material as will be known to those of skill in the art. Different materials may provide different tactile sensations to a user. It will be appreciated that any suitable material may be used in the construction or manufacture of the applicator.

In certain embodiments, there is provided herein a method of introducing a shaving solid into a resealable shaving solid applicator. In an embodiment of a method of introducing a shaving solid into a resealable shaving solid applicator, the shaving solid applicator may comprise a support for a shaving solid as disclosed above, and a lower removable section as disclosed above, which together may form a receptacle. In a further embodiment of a method of introducing a shaving solid into a resealable shaving solid applicator, the method may comprise the steps of introducing a shaving solid in a liquid state into the lower removable section while the lower removable section is oriented on a filling base and joined or associated with the support for a shaving solid in such a manner that the lower removable section may be filled with shaving solid in liquid form to above the level of the resilient tabs of the support for a shaving solid. In some embodiments, the plane of the filling base and the longitudinal axis of the support for a shaving solid may be substantially parallel. In some embodiments, the shaving solid may be in liquid form as a result of heating causing melting, or the shaving solid may be in liquid form because an initiator or polymerizing agent or otherwise gelling or solidifying reagent has not yet been added to the shaving composition to cause it to gel or solidify. The shaving solid in a liquid state may be introduced by a hot-pour and/or a top-fill process, or other molding or injection molding process as will be known to those of skill in the art. Following introduction of the shaving solid in liquid form, the shaving solid may be allowed or triggered to solidify or gel, forming a shaving solid molded in the form of the inside of the lower removable section, and engaged, joined, coupled, or otherwise mechanically linked to the resilient tabs and or fluid communication channels of the support for a shaving solid. The shaving solid may be allowed or triggered to solidify or gel by, for example, cooling, or by addition of a polymerizing, gelling or otherwise solidifying agent.

In certain embodiments, the lower removable section, which may function as a mold, may define the shape and quantity of a shaving solid, may mold a shaving solid so as to optimize shape for contact to the skin, optimize shape for use on varying surfaces of the body, and may ensure a suitable quantity of shaving solid is provided which optimizes quantity available for use and/or weight of the shaving solid which may affect use. The lower removable section may help preserve the shaving solid by partially or fully eliminating air and/or air flow around at least a portion of the surface of a shaving solid, which may prevent drying out. An insert assisting in some or all of these functions may also be provided. The lower removable section may function as a lid.

In some embodiments, the resealable shaving solid applicator of the method as described above may further comprise an upper section capable of interlocking with, engaging with, coupling with, snapping, hooking, clipping, or otherwise joining to the support for a shaving solid, and the method may further comprise a step of coupling or otherwise associating the upper section with the support for a shaving solid.

In some embodiments of a method provided herein, the shaving solid may be a propylene glycol-based solid shaving composition comprising less than 15% by wt. of a fatty acid salt and having a melting point between about 38° C. and about 49° C. when saturated with water. The shaving solid may be a shaving solid as disclosed in PCT application number PCT/CA2013/000781, which is herein incorporated by reference. As will be recognized by those of skill in the art, the term "shaving solid" is intended to refer to any of a variety of suitable shaving compositions known in the art. Although the term "shaving solid" is used, it should be recognized that any suitable shaving compound or composition, which may comprise shaving gel, shaving liquid, and shaving foam, is also encompassed by the term "shaving solid".

As will be understood by those of skill in the art, the term "hot-pour process" is intended to mean a process in which a solid, for example a shaving compound, material or composition, is heated to produce a liquefied phase, which may be poured into a receptacle or mold, such as a lower removable section as described above. Once poured, the heated liquefied phase may be allowed to solidify, completing the process. In some embodiments provided herein, a poured soap base or an extruded soap base may be used. One non-limiting embodiment of a hot-pour process is referred to in PCT application number PCT/CA2013/000781.

In one embodiment of a hot-pour process, shaving solid ingredients may be combined and heated in a liquefied phase and poured into a mold such as a lower removable section. The heated and liquefied phase to be poured, for example, from above, into the mold and retained therein. The mold may be used to mold the shaving solid and reduce air around a portion of the shaving solid intended for contact on a users skin, and may at least partially reduce drying and hardening of the shaving solid, and/or may allow for a more uniform surface finish. A hot-pour process may allow air bubbles and particular ingredients to rise and settle into an inconspicuous area, such as an area that may concealed, for example an area that is hidden when an upper section is installed to the support for a shaving solid as described above. The mold may be coated with a release agent prior to pouring the heated and liquefied phase, which may allow for efficient and clean removal of the mold by the user when using a finished product.

In another embodiment of a hot-pour process, a heated and liquefied phase may be poured into a mold, such as a lower removable section as described herein, and filled to a level that covers at least a portion of one or more resilient wings located on an installed support for a shaving solid as described herein. A level indicator for indicating the ideal fill level may be provided to assist in quality control. After a heated and liquefied phase is poured into a mold, the liquefied phase may be allowed to cool or may be cooled. Typically, non-process sensitive ingredients may be heated to around 80° C. and process sensitive ingredients may be incorporated in around 65° C. A heated and liquefied phase may be poured into a mold at around 65° C. Reheating and/or refilling may be implemented to compensate for capillary action, air bubbles, settling ingredients and shrinkage of the liquid. As described herein, liquid communication channels may be located on a support for a shaving solid, and may allow a heated, liquefied shaving solid to flow through the thickness of resilient wings on the support for a shaving solid, so as to form a mechanical interlock (e.g., by flowing together to form a unitary mass) on the back side of the wings, which may secure the shaving solid to the wings once cooled. Upon sufficient solidification of the shaving solid material, an upper section may be inserted onto the support for a shaving solid which may be connected to a mold such as a lower removable section as described herein.

In another embodiment, use of a hot pour process and a lower removable section may obviate the need for an intermediate step in which hot liquid is poured into separate molds, and may reduce the need for additional equipment (molds). Additional steps of removing solidified product from a mold and processing and handling the solidified product may be avoided.

As will also be understood by those of skill in the art, a "top-fill process" is intended to mean a process, for example a molding process or a hot-pour process, in which a receptacle or mold, such as a lower removable section as described above, is filled by introducing a filling into the receptacle or mold at the top of the receptacle or mold.

It will be understood to those of skill in the art that terms such as "associated", "joined", "coupled" "interlocking", "engaging", "coupling", "snapping", "hooking", and "clipping" are intended to refer to any suitable means for linking or associating two components together. Some non-limiting examples may include male and female clips, engaging surfaces that fit together frictionally, sliding mechanisms, one or more rims or ridges and a snapping mechanism, or magnetism.

The term "resilient" is intended to refer to an element capable of returning to an original position after having been flexed.

It will be appreciated that the embodiments described herein are for illustrative purposes, and not intended to be limiting in any way.

EXAMPLE 1

Resealable Shaving Solid Applicator

One example of a resealable shaving solid applicator is described in further detail below with reference to FIGS. 1, 2, and 4. This example is provided as a non-limiting embodiment for illustrative purposes, and it will be understood that this example is not intended to be limiting in any way.

One example of a resealable shaving solid applicator is illustrated in FIG. 1. In the example shown, in which an optional shaving solid (4) is also illustrated, the resealable shaving solid applicator (1) comprises an upper section (2), a support for a shaving solid (3) which is engagable with the upper section (2), and a lower removable section (5). In the illustrated example, the support for a shaving solid (3) comprises a set of locking tabs (7) (or male or female locking clips) for coupling the support for a shaving solid (3) to the upper section (2). The support for a shaving solid (3) is also capable of mounting a shaving solid (4), as will be described in more detail below. When joined to the upper section (2), the support for a shaving solid (3) is oriented to expose a surface of a shaving solid (4) for application to a user. The lower removable section (5) of the resealable shaving solid applicator (1) shown in FIG. 1 is capable of reversibly engaging with the support for a shaving solid (3). In an embodiment, the lower removable section (5) may snap over a ridge on the support for a shaving solid (3) to become engaged. When engaged, the lower removable section (5) may function as a removable lid, protecting a shaving solid (4) mounted to the support for a shaving solid (3) during a period of storage or inactivity. When the lower removable section (5) is removed, the shaving solid (4) is accessible for application to a user. Following use, in some embodiments the lower removable section (5) may be re-engaged to reseal the shaving solid applicator. In an embodiment, the lower removable section (5) may be coated with a non-stick coating or a release agent to prevent sticking to a shaving solid (4).

In the embodiment illustrated in FIG. 1, the upper section (2) includes depressions (6) serving as finger grips to enhance the user's grasp of the applicator during use. In the embodiment illustrated in FIG. 1, the upper section (2) also includes a grip including a finger catch (37) for enhanced usability, especially in wet conditions.

In the embodiment illustrated in FIG. 1, the lower removable section (5) comprises a first base (10) and a second base (8*a*). The upper section (2) also comprises a base (8*b*), which aligns with the second base (8*a*) of the lower removable section (5) to form an expanded version of the second base. In the example shown, the first base (10) and the second base (8*a*, 8*b*, or 8*a* and 8*b*) allow the resealable shaving solid applicator to be oriented in a first orientation, and in a second orientation, respectively. In an embodiment, the two bases are substantially perpendicular, allowing the resealable shaving solid applicator to be oriented in a first orientation and a second orientation wherein the first orientation and the second orientation are substantially perpendicular to one another. In the provided example, the base (8*b*) is capable of supporting the resealable shaving solid applicator in the second orientation, which is a substantially upright position and may elevate at least a portion of a shaving solid above a surface, when the lower removable section (5) is either removed or engaged.

In the example illustrated in FIG. 1, the first base (10) is substantially parallel to the plane of the support for a shaving solid (3). In an embodiment, the first base (10) may be used for support while a shaving solid is being incorporated, as described in more detail below.

Also in the example illustrated in FIG. 1, orienting the resealable shaving solid applicator on the second base (formed by (8*a*) and (8*b*), or by (8*b*) alone when the lower removable section (5) is removed) positions the resealable shaving solid applicator in a substantially upright position. Such a substantially upright position may discourage water from pooling on the shaving solid (4).

In the embodiment illustrated in FIG. 1, the lower removable section (5), which may function as a shaving solid mold as described in more detail below, comprises an inside surface which is optionally substantially concave on at least one end. The lower removable section (5) also comprises a protrusion (9) located in the vicinity of the at least one inside concave end. In an embodiment, the inner concave- or curved- shaped end of the lower removable section (5), in co-operation with a correspondingly rounded or curved shaving solid (4), allows the lower removable section to be removed to reduce damaging, scraping, or dislodging a shaving solid (4) from the support for a shaving solid (3). In a further embodiment, such a configuration may allow the lower removable section may be removed at an angle, or opened as if on a hinge, without damaging, scraping, or dislodging the shaving solid from the support for a shaving solid. In the example illustrated in FIG. 1, the protrusion (9) provides a user with a convenient means for removing the lower removable section (5).

In an embodiment, the shaving solid (4) is a propylene glycol-based solid shaving composition comprising less than 15% by wt. of fatty acid salt and having a melting point between about 38° C. and about 49° C. when saturated with water. In another embodiment, the shaving solid (4) and the support for a shaving solid (3) to which it is mounted may be removed by a user, and replaced with a new shaving solid (4) mounted to a new support for a shaving solid (3). In this manner, the shaving solid (4) mounted to a support for a shaving solid (3) may be a user replaceable element or refillable consumable.

Figure 4A:
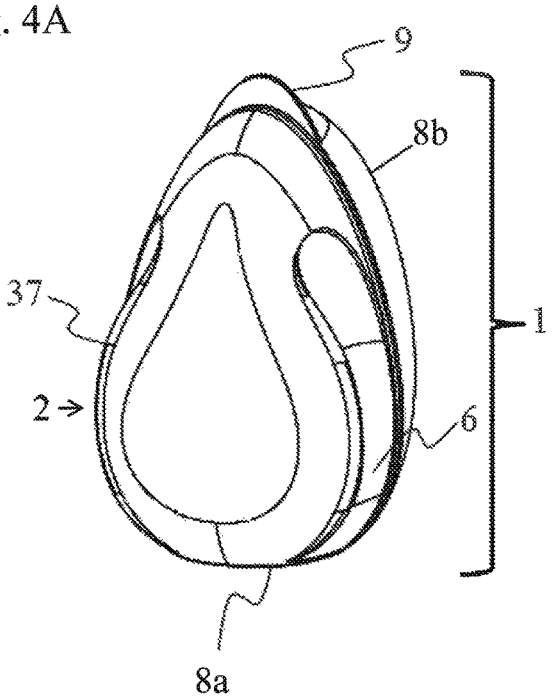
FIG. 4 shows [A] a front view illustrative of an embodiment of a resealable shaving solid applicator supported upright on a surface by a second base formed by the upper section and lower removable section; and [B] a back view illustrative of an embodiment of a resealable shaving solid applicator supported upright on a surface by a second base formed by the upper section and lower removable section, wherein a first filling base on the lower removable section, oriented substantially perpendicular to the second substantially flat base, is visible.
Figure 4B:
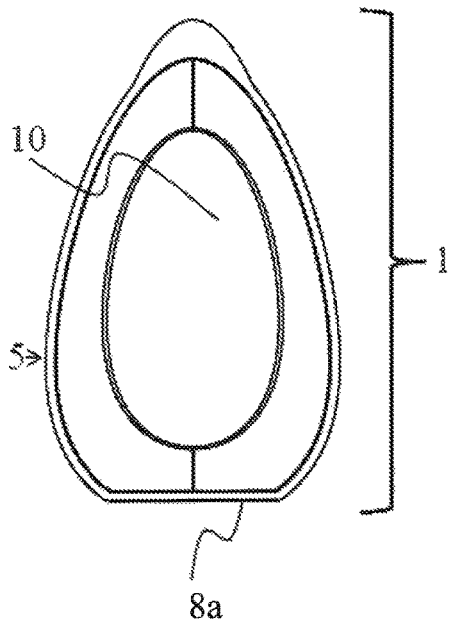

The example illustrated in FIG. 1 may be further understood from the illustrations provided in FIGS. 4A and 4B, in which an embodiment of a resealable shaving solid applicator (1) with an engaged lower removable section (5) is shown. In FIGS. 4A and 4B, the resealable shaving solid applicator (1) is standing upright on a second base formed by the bases (8*a*) and (8*b*). In FIG. 4B, a back view of the resealable shaving solid applicator (1) standing in an upright position, a first base (10), which is not being used while the shaving solid applicator (1) is standing in the upright position, is visible.

Figure 2A:
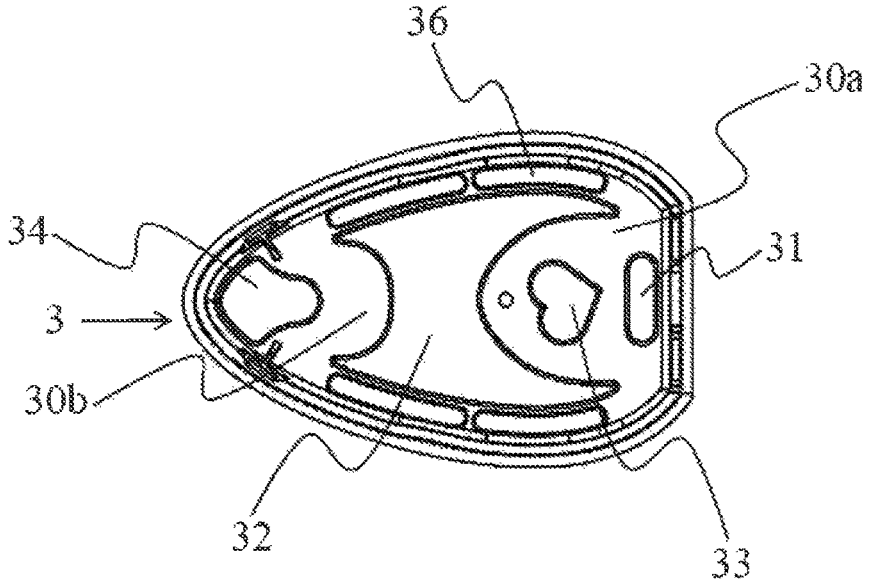
FIGS. 2A, 2B, and 2C show top, cross section side, and side views, respectively, illustrative of an embodiment of a support for a shaving solid; and 2C further shows a resilient wing in a flexed or deflected position.
Figure 2B:
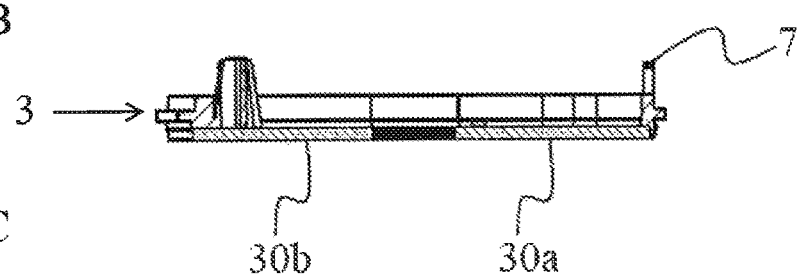
Figure 2C:
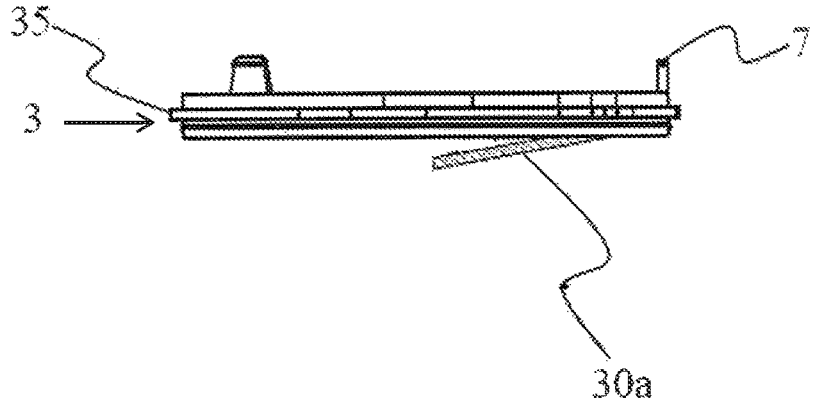

An embodiment of a support for a shaving solid (3) suitable for use in the resealable shaving solid applicator (1) embodiment illustrated in FIG. 1 is shown in FIGS. 2A, 2B, and 2C. The support for a shaving solid (3) comprises resilient tabs (30*a*) and (30*b*). In this embodiment, the support for a shaving solid (3) further comprises fluid communication channels (36), (34), (32), and (31). As described in more detail below, a shaving solid may be introduced as a liquid phase of a shaving solid. As the liquid phase of a shaving solid is introduced, it may flow from the bottom face of the support for a shaving solid (3), through the fluid communication channels (36), (34), (32), and (31), to the top face of the support for a shaving solid (3), encompassing the resilient tabs (30*a*) and (30*b*) in the process. Following solidification of the shaving solid (4), the shaving solid (4) may be securely mounted to the support for a shaving solid (3), at least partially through secure engagement with the resilent tabs (30*a*) and (30*b*).

As shown in the embodiment of a support for a shaving solid (3) shown in FIGS. 2A, 2B, and 2C, the support for a shaving solid (3) may further comprise an indicator (33), which may indicate to the user a shaving solid level. By way of example, when the levels of shaving solid (4) become nearly exhausted, the indicator (33) may become visible to the user, signalling to the user that the supply is nearly depleted. The indicator may also serve to convey messages, information, or other symbols to the user. In an embodiment, the indicator (33), in addition, may also function as a fluid communication channel.

EXAMPLE 2

Method of Introducing a Shaving Solid Into a Resealable Shaving Solid Applicator An example of a method of introducing a shaving solid into a resealable shaving solid applicator is described in further detail below with reference to FIGS. 3 and 5. This example is provided as a non-limiting embodiment for illustrative purposes, and it will be understood that this example is not intended to be limiting in any way.

An example of a method of introducing a shaving solid into a resealable shaving solid applicator, for example a resealable shaving solid applicator as described in Example 1, may be better understood having reference to FIG. 3. In this example, a resealable shaving solid applicator comprising a support for a shaving solid (3) having one or more resilient tabs and optionally comprising one or more fluid communication channels (for example, as described above with reference to FIG. 2), and a lower removable section (5), is used to mold or cast a shaving solid (4) for use in a resealable shaving solid applicator.

Figure 3A:
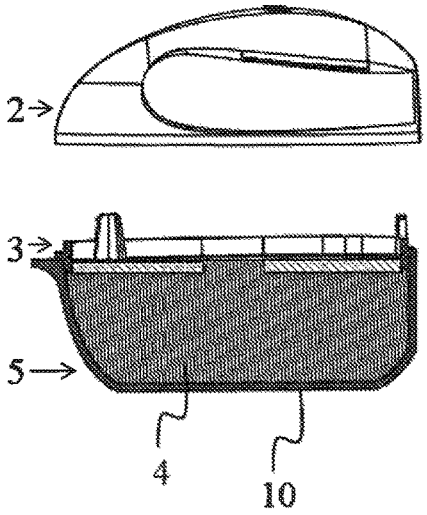
FIG. 3 shows [A] a side view illustrative of an embodiment of a partially assembled resealable shaving solid applicator which is supported on a first filling base of a lower removable section, in which a liquid form of a shaving solid has been introduced to the lower removable section joined to a support for a shaving solid, and solidified to engage with the support for a shaving solid, and an upper section is not yet engaged with the support for a shaving solid; and [B] a side view illustrative of an embodiment of a resealable shaving solid applicator filled with a shaving solid in which the lower removable section has been reversibly unsealed, exposing a surface of a shaving solid to the environment.

As illustrated in FIG. 3A, the lower removable section (5) may be coupled or otherwise associated with the support for a shaving solid (3), and may be oriented on its first base (10), which serves as a filling base in the illustrated embodiment. In an introducing step, a shaving solid, for example a shaving composition, compound, solid, or gel as described above, in a liquid or fluid form, may be introduced to the lower removable section (5), which in the illustrated embodiment may serve as a mold for a shaving solid. The introducing step may be, for example, a hot-pour process, a top-fill process, an injection molding process, or another suitable introducing method or process.

In the embodiment shown in FIG. 3A, a shaving solid (4), which is a propylene glycol-based solid shaving composition comprising less than 15% by wt. of fatty acid salt and having a melting point between about 38° C. and about 49° C. when saturated with water, is introduced to the lower removable section (5) in a hot-pour and/or top-fill process in which the shaving solid (4) is melted to a liquid or substantially fluid state, and poured into the lower removable section (5) until the liquid level passes above at least a portion of the associated or coupled support for a shaving solid (3). In the illustrated example, the liquid is poured such that the liquid level rises above the resilient tabs of the support for a shaving solid (3), passing through the fluid communication channels of the support for a shaving solid (3) in order to traverse from one face of the support for a shaving solid to the other. In a subsequent step, occurring after the shaving solid in a liquid form has been introduced, the shaving solid is allowed to solidify. The solidified shaving solid will at least partially encompass the resilient tabs of the support for a shaving solid (3), such that it is mounted or anchored to the support for a shaving solid (3). It will also be understood that the solidified shaving solid (4) will be molded in the form of the inside of the lower removable section (5), which may serve as a mold in this embodiment. In the illustrated embodiment, an upper section (2) does not prevent introduction of the shaving solid.

Figure 3B:
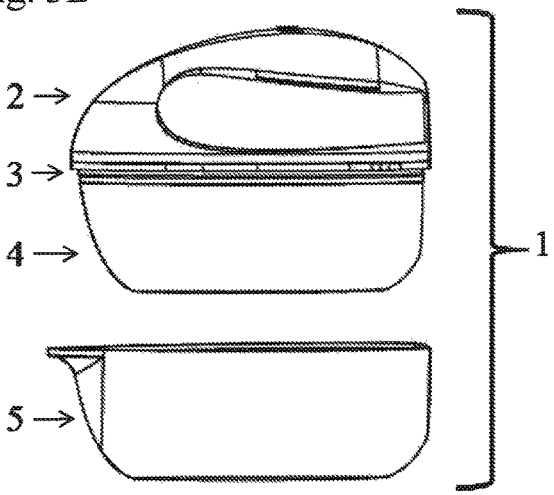

In the embodiment shown in FIG. 3B, the resealable shaving solid applicator may further comprise an upper section (2). Also in the embodiment of FIG. 3B, the method may further comprise a subsequent step of coupling or otherwise attaching an upper section (2) to the support for a shaving solid (3), which in this embodiment has an associated shaving solid (4) introduced in the previous method step(s). The embodiment illustrated in FIG. 3B shows a resealable shaving solid applicator with an introduced shaving solid (4), in which the removable lid (5) has been removed from the resealable shaving solid applicator (1).

Figure 5:
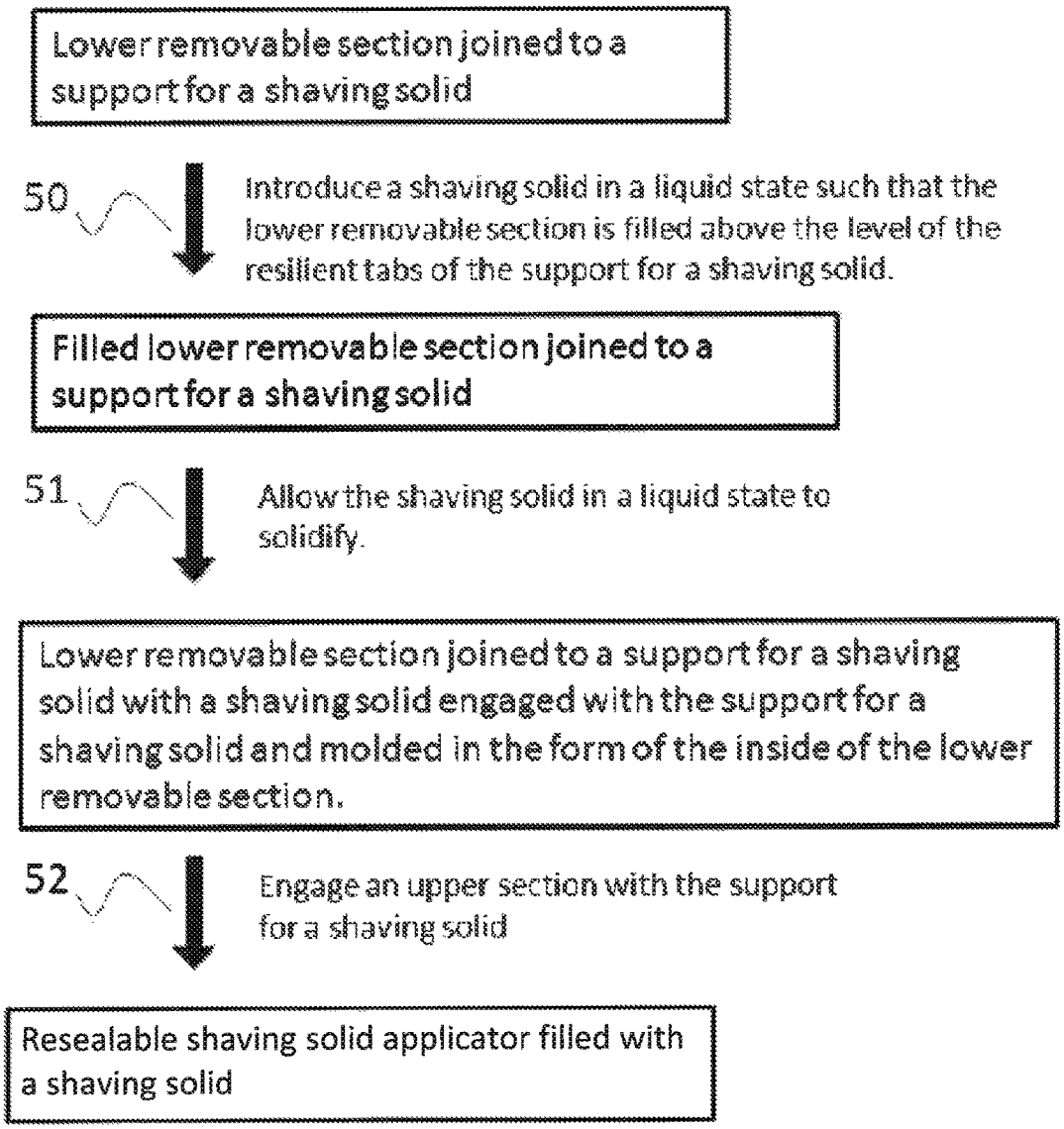
FIG. 5 is a flow chart illustrative of the steps of an embodiment of a method of filling an applicator.

A flow chart illustrating steps and optional steps comprising a method of introducing a shaving solid into a resealable shaving solid applicator is provided in FIG. 5. In the illustrated embodiment, a shaving solid in a liquid state is introduced (50) to a lower removable section joined to a support for a shaving solid such that the lower removable section is filled above the level of at least a portion of the one or more resilient tabs of the support for a shaving solid. A filled lower removable section joined to a support for a shaving solid is formed. In step (51), the shaving solid in liquid form is allowed to solidify, forming a lower removable section joined to a support for a shaving solid with a shaving solid engaged with the support for a shaving solid and molded in the form of the inside of the lower removable section. In optional step (52), an upper section is engaged with the support for a shaving solid, forming an example of a resealable shaving solid applicator filled with a shaving solid.

Although this invention has been shown and described with respect to the detailed embodiments thereof, it will be understood by those of skill in the art that various changes may be made and equivalents may be substituted for elements thereof without departing from the scope and spirit of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of this disclosure.

What is claimed is:

1. A resealable shaving solid applicator comprising:

an upper section;

a support for a shaving solid which is engagable with the upper section to form a shaving solid applicator oriented to expose a surface of a shaving solid for application, and which comprises one or more resilient tabs for engaging a shaving solid to form a mounted shaving solid; and a lower removable section joinable to the shaving solid applicator such that a shaving solid mounted on the shaving solid applicator is sealed from the surrounding environment when the lower removable section is in a joined position, wherein the support for a shaving solid further comprises one or more fluid communication channels for engaging a shaving solid.

2. The resealable shaving solid applicator of claim 1, wherein the lower removable section further comprises two or more bases such that the resealable shaving solid applicator may be stably positioned in two or more orientations.

3. The resealable shaving solid applicator of claim 1, wherein the lower removable section comprises a first base and a second base, wherein the first base allows the resealable shaving solid applicator to be positioned in a first orientation, and wherein the second base allows the resealable shaving solid applicator to be positioned in a second orientation.

4. The resealable shaving solid applicator of claim 3, wherein the first and second bases are substantially perpendicular to one another.

5. The resealable shaving solid applicator of claim 3, wherein the first base is substantially parallel to the longitudinal axis of the support for a shaving solid when joined to the lower removable section.

6. The resealable shaving solid applicator of claim 3, wherein the second base is for supporting the resealable shaving solid applicator in an upright position.

7. The resealable shaving solid applicator claim 1, wherein the upper section comprises a base for stably supporting the resealable shaving solid applicator in an upright position.

8. The resealable shaving solid applicator of claim 7, wherein the base on the upper section stabilizes the resealable shaving solid applicator in an upright position when the lower removable section is removed, joined, or both.

9. The resealable shaving solid applicator of claim 2, wherein the upper section comprises a base aligned such that the base of the upper section is at least partially continuous with a base of the lower removable section when the lower removable section is joined, so as to form an expanded base for supporting the resealable shaving solid applicator in an upright position.

10. The resealable shaving solid applicator of claim 1, wherein the upper section further comprises one or more grips for a user.

11. The resealable shaving solid applicator of claim 1, wherein the support for a shaving solid further includes one or more indicators for indicating a shaving solid level.

12. The resealable shaving solid applicator of claim 1, wherein an inside or inside surface of the lower removable section is substantially concave on at least one end, allowing the lower removable section to be removed from the resealable shaving solid applicator to reduce damage caused to a shaving solid during pivotal release.

13. The resealable shaving solid applicator of claim 12, wherein the lower removable section further comprises a protrusion for simplifying removal of the lower removable section from the resealable shaving solid applicator, the protrusion protruding from the at least one concave end.

14. The resealable shaving solid applicator of claim 1 further comprising a shaving solid.

15. The resealable shaving solid applicator of claim 14, wherein the shaving solid is a propylene glycol-based solid shaving composition comprising less than 15% by wt. of fatty acid salt and having a melting point between about 38° C. and about 49° C. when saturated with water.

16. The resealable shaving solid applicator of claim 14, wherein the shaving solid is mounted to the support for a shaving solid to form a mounted shaving solid.

17. The resealable shaving solid applicator of claim 14, wherein the mounted shaving solid comprising the support for a shaving solid and the shaving solid is a user-replaceable consumable.

18. The resealable shaving solid applicator of claim 1, wherein the inside of the lower removable section is coated with a non-stick coating to prevent the shaving solid from sticking to the inside of the lower section.

19. The resealable shaving solid applicator of claim 1, wherein the accessible surface area of the shaving solid is from about 17 $cm^2$ to about 40 $cm^2$.

* * * * *